US008820772B2

(12) United States Patent
Andersson et al.

(10) Patent No.: US 8,820,772 B2
(45) Date of Patent: Sep. 2, 2014

(54) HEEL UNIT FOR A TOURING BINDING

(75) Inventors: Fredrik Andersson, Munich (DE); Edwin Lehner, Gilching (DE)

(73) Assignee: Salewa Sportgeraete GmbH, Aschheim (DE)

( * ) Notice: Subject to any disclaimer, the term of this patent is extended or adjusted under 35 U.S.C. 154(b) by 74 days.

(21) Appl. No.: 13/547,204

(22) Filed: Jul. 12, 2012

(65) Prior Publication Data

US 2013/0062862 A1 Mar. 14, 2013

(30) Foreign Application Priority Data

Sep. 13, 2011 (DE) ..... 10 2011 082 612

(51) Int. Cl.
*A63C 9/084* (2012.01)

(52) U.S. Cl.
USPC ..... 280/625; 280/614

(58) Field of Classification Search
USPC ..... 280/611, 614, 615, 623, 624, 625, 626, 280/627, 628, 633, 634, 635
See application file for complete search history.

(56) References Cited

U.S. PATENT DOCUMENTS

| | | | | | |
|---|---|---|---|---|---|
| 3,630,538 | A * | 12/1971 | Klein et al. | ..... | 280/623 |
| 4,358,131 | A * | 11/1982 | Schwartz | ..... | 280/614 |
| 5,879,020 | A * | 3/1999 | Buquet | ..... | 280/633 |
| 2011/0175328 | A1 * | 7/2011 | Indulti | ..... | 280/623 |
| 2011/0203138 | A1 * | 8/2011 | Shute et al. | ..... | 36/92 |

FOREIGN PATENT DOCUMENTS

| | | | | |
|---|---|---|---|---|
| AT | 402 020 | B | 1/1997 | |
| EP | 0 199 098 | B1 | 10/1986 | |
| EP | 0 519 243 | A1 | 12/1992 | |
| EP | 2 345 462 | A1 * | 7/2011 | ..... A63C 9/08 |
| EP | 2 345 463 | A1 | 7/2011 | |
| WO | 2009/105866 | A1 | 9/2009 | |

* cited by examiner

*Primary Examiner* — Frank Vanaman
(74) *Attorney, Agent, or Firm* — Rothwell, Figg, Ernst & Manbeck, P.C.

(57) ABSTRACT

A heel unit for a touring binding of a sliding board, comprising a binding body on which two coupling projections for connection to a heel portion of a touring boot are movably held, wherein the movable retainer of the coupling projections is configured such that the coupling projections move away from a sliding board plane.

20 Claims, 4 Drawing Sheets

HEEL UNIT FOR A TOURING BINDING

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The present invention relates to a heel unit for a touring binding of a sliding board, comprising a binding body on which two coupling projections for connection to a heel portion of a touring boot are movably held.

2. Description of Related Art Including Information Disclosed Under 37 CFR 1.97 and 1.98

Heel units of this type have become widespread, particularly in the sport of ski touring, to fix the heel of a touring boot to a sliding board (touring ski, splitboard or similar) in that the coupling projections formed on the front ends of two coupling pins engage in associated recesses on the heel of the ski boot.

Examples of heel units of the aforementioned type are disclosed in EP 0 199 098 A2 and in AT 402 020 B. The known bindings each use two coupling pins which are held on a housing of the heel unit in such a way that they run parallel to each other and protrude towards the touring boot. Moreover, the pins are movable in relation to each other in a plane parallel to a sliding board plane (in the horizontal plane) while overcoming a restoring force in order to provide a release mechanism for release in the event of a forward fall. Release of the known heel unit on a touring boot will be described below in greater detail with reference to FIG. 1.

Figure 1:
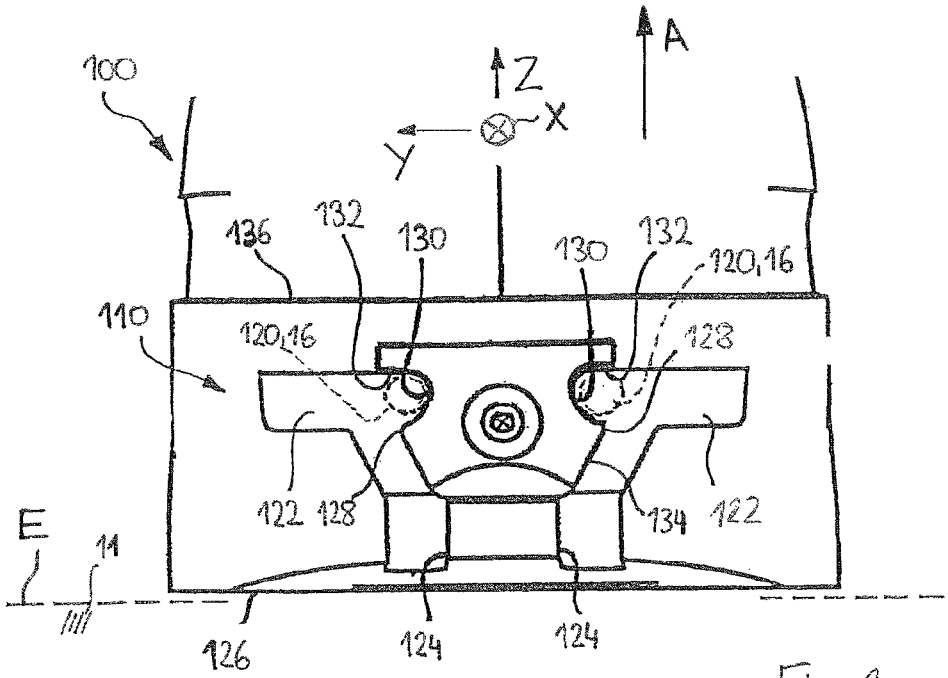

FIG. 1 shows a touring boot 100 in a view from behind (along the longitudinal axis of the sliding board running in the X direction). The sectional diagram of FIG. 1 illustrates a heel portion 110 of touring boot 100. Also indicated are two coupling pins 120 which protrude from the heel unit (not shown) in the X direction and engage in recesses 122 of touring boot 100. The inner margins of recesses 122 each comprise opening portions 124 at which recesses 122 are open towards a sole surface 126 of boot 100, release projections 128 which protrude away from the middle of the boot in a Y direction (perpendicular to a vertical Z direction and perpendicular to the X direction), latching portions 130 in the shape of notches into which coupling pins 120 may engage, and upper contact surfaces 132 which run essentially in the Y direction.

In the position shown in FIG. 1, coupling pins 120 are preloaded and can be moved out of this position in a horizontal plane (Y direction) away from each other by means of an elastic device (not shown) of the heel unit. In the position shown in FIG. 1, coupling pins 120 are in engagement with the notches of latching portions 130 and touring boot 100 is secured on the heel unit (downhill position).

It can also be seen in FIG. 1 that the inner margin of recesses 122 additionally has insertion contours 134 in relation to the Z-axis between release projections 128 and opening portions 124. The gap between both insertion contours 134 of both recesses 122 enlarges with increasing distance from sole 126 of touring boot 100. This makes it possible when stepping into the touring binding of touring boot 100 to approach coupling pins 120 from above in such a way that coupling pins 120 enter opening portions 124 via sole 126 and on further lowering of heel portion 110 they are spread apart by insertion contours 134 against the action of the elastic device of the heel unit. After further downward motion of heel portion 110 by overcoming the force of the elastic device, coupling pins 120 pass release projections 128 until they engage in the notches of latching portions 130. The touring boot is then in the normal position (downhill position) with the heel unit coupled.

In the event of an My-release, in which a torque acts on touring boot 100 about an axis running in the Y direction such that heel portion 110 is moved upwards in the direction of arrow A in FIG. 1, and with a force that exceeds a predetermined release force (e.g. during a fall), coupling pins 120 are forced sideways by release projections 128 out of their position shown in FIG. 1 such that they move apart from each other in the horizontal plane. As soon as heel portion 110 moves upwards in such a way that release projections 128 are disposed above the middle, measured in the Z direction, of coupling pins 120, touring boot 100 may be moved further upwards in the direction of arrow A without further exertion of force whereupon coupling pins 120 slip off release projections 128 until they exit from opening portions 124 on sole 126 of touring boot 100. The touring boot is then released and disengaged from the ski (at least in the heel region).

When the touring binding is loaded, e.g. during downhill travel, the decision is made as to whether or not the heel unit will release, i.e. whether or not coupling pins 120 will exit recesses 122, within the short distance between the position of coupling pins 120 inside latching portions 130 shown in FIG. 1 and the point at which release projections 128 are passed. Particularly with a sporty skiing style (e.g. in competitive sport), relatively high forces may act momentarily on the sliding board when travelling over obstacles, uneven ground or during brief collisions with rocks or similar on the ski slope. An abrupt, brief load which may temporarily be large enough to overcome the release force for spreading apart coupling pins 120 then acts between touring boot 100 and the heel unit. The coupling pins therefore tend to overcome release projections 128 even in the case of a brief impact or shock such that the touring boot is released from the heel unit although this temporary disruptive event is not yet connected to a fall by the skier. The known binding therefore leads in some cases, particularly with a sporty skiing style, to an undesirable inadvertent release.

BRIEF SUMMARY OF THE INVENTION

The object of the invention is to provide a heel unit which, on one hand, ensures reliable My-release of the touring boot in the event of a fall and, on the other, for the most part prevents inadvertent releases even when travelling downhill in more demanding terrain, particularly during sporty or competition-oriented downhill travel.

According to the invention, this object is achieved by a heel unit for a touring binding of a sliding board, comprising a binding body on which two coupling projections for connection to a heel portion of a touring boot are movably held, whereby the movable retainer of the coupling projections is configured such that the coupling projections move away from the sliding board plane.

According to an important feature of the invention, the heel unit has coupling projections which are movable in a direction which has at least one component directed away from the sliding board. Thus, while the coupling projections provided on coupling pins of known heel units were forced to move exclusively in the horizontal plane (parallel to the sliding board plane) due to corresponding support of the coupling pins on the heel unit, the coupling projections of the heel unit according to the invention are set up for a movement running diagonally to the sliding board plane or orthogonally to the sliding board plane.

It should be noted at this point that within the scope of the present disclosure all details such as "horizontal", "vertical", "lateral", "forwards", "backwards", "downwards", "upwards", etc. relate to a heel unit which is fixed to a sliding board arranged in a horizontal plane. The sliding board plane and also a sliding board longitudinal axis are defined in this case by a fixing portion of the heel unit, for example fixing holes on a base part of the heel unit.

Due to the motion component of the coupling projections according to the invention in a direction leading away from the sliding board plane, the effect achieved is that, in the event of a torque acting on the touring ski about a Y-axis such that a heel portion of the touring ski moves upwards away from the sliding board plane, the coupling projections can follow the movement of the heel portion on a specific path before having moved so far in relation to the heel portion that the engagement between the coupling projections and the heel portion is broken. In other words, the present invention allows the creation or significant enlargement of a release path on which the touring boot moves in relation to the heel unit starting from the normal engagement position until the actual release takes place.

This means in turn that the heel unit does not release immediately if a force exceeding the predetermined release force of the heel unit of the touring ski acts on the heel portion of the touring ski but rather only releases if this force effect continues until the heel portion has gone beyond the release path. In the case of a brief abrupt load during which release is undesirable, e.g. in the case of a knock when travelling over an obstacle or during a particularly demanding ski manoeuvre, although the release force is exceeded for a short time such that the heel portion of the touring boot moves a little further along the release path away from the sliding board, the load or force acting on the touring ski decreases again after a short time to below the predetermined threshold value, i.e. the release force of the heel unit, such that further movement of the touring boot in relation to the heel unit along the release path is prevented. Consequently, the touring boot does not reach the actual release position but returns again to the normal position under the effect of the restoring force of the heel unit. An undesirable inadvertent release can therefore be prevented in the case of such a temporary load which is not generally caused by the skier falling.

The release according to the invention with movement of the coupling portions in a direction leading away from the sliding board plane can also be described with reference to a variable denoted as release energy. If, at every point of the release path, one considers the force acting between touring boot and heel unit towards returning the touring boot to the normal position, then the release energy emerges as an integral of this restoring force over the release path, i.e. from the normal position up to the release point at which there is no longer any restoring force acting on the heel portion and the touring boot is released. By creating or lengthening the release path, it is then possible according to the invention, by appropriately specifying/setting the restoring force or release force (e.g. spring force) and the release path, to specify a predetermined release energy which must be transferred by the touring boot to the heel unit so that the heel unit releases.

Basically, the movement according to the invention of the coupling projections may be a movement running essentially vertically away from the sliding board plane such that during the release procedure the coupling projections are first pulled vertically upwards with the heel portion of the boot and are freed from the heel portion after going beyond a specific distance. For example, the coupling projections on the heel unit may be guided such that they first move vertically upwards against the force of a resetting device and are then driven away from each other in order to be released from corresponding latching sections on the heel portion of the touring boot.

In a preferred embodiment of the invention, the movable retainer of the coupling projections is configured such that the coupling projections move along a direction of motion which runs diagonally away from the sliding board plane and diagonally to the sliding board normal. This allows cooperation of the heel unit with conventional type touring boots which have a release contour in their heel portion that permits a release of the coupling projections by means of a movement of the coupling projections in a direction away from each other. The movement device running diagonally to the sliding board plane and the sliding board normal according to this exemplary embodiment then facilitates, as the touring boot moves along the release path, the tracking movement according to the invention of the coupling projections away from the sliding board plane, on the one hand, to increase the release path and, on the other hand, at the same time to facilitate the movement of the coupling projections away from each other to ensure final complete release of the touring boot.

In a heel unit of another embodiment of the invention, it may further be provided that the movable retainer of the coupling projections is configured for a movement of the coupling projections from a first position into a second position against the action of a release force, wherein a distance of the coupling pins from the sliding board plane is greater in the second position than in the first position, and wherein an intermediate distance of the coupling pins from each other is greater in the second position than in the first position. In this case, the first position of the coupling projections corresponds to an unloaded position in which the coupling projections are not in engagement with the boot or are not subject to any appreciable forces in the direction of My-release (touring boot in normal position or unloaded downhill position). The second position corresponds to a position of the coupling projections in which they have already moved part of the way towards the release position or have just reached the release position for release of the touring boot. A normal position of the touring boot is defined by the first position of the coupling projections, in which position the touring boot is held at the heel unit in the unloaded case or in the case of a lower load. The second position defines a pre-release position or a release position of the boot in which the touring boot has moved over at least part of the release path in relation to the heel unit, whereby the embodiment described ensures that a movement takes place between a first position and a second position by overcoming a release force. Preparation is made to release the touring boot by increasing the distance between the coupling projections in the second position, while carriage of the coupling projections along with the heel portion of the touring boot to enlarge the release path is achieved by increasing the distance between the coupling projections and the sliding board plane in the second position.

In a technically simple implementation of the movable coupling projections, they may be provided on the front ends of coupling pins, whereby the coupling pins each have retaining portions on which they are pivotably supported on the binding body. The pivotable support may be configured in such a way that the movement according to the invention of the coupling projections away from the sliding board plane is permitted together with other directions of motion (e.g. ball joint). Alternatively, a specific direction of motion of the coupling projections may be specified by corresponding orientation of a bearing axis of the coupling pins. Alternatively or in addition, consideration is given to forcing the coupling pins onto a desired movement path or into a desired direction of motion by means of at least one lateral guide. A guide disposed at a distance from the pivot axis of the coupling pins can introduce the relatively high forces emanating from the boot and acting on the coupling pins steadily into the heel unit.

If the coupling projections are provided on pivotable coupling pins, then particular consideration is given in a further embodiment to providing carrier portions on the coupling pins which are brought into engagement or can be brought into engagement with a transmission part, whereby the transmission part is movably held on the binding body such that in at least one direction it is only movable by overcoming a predetermined force, in particular the force of a release spring means. This embodiment provides a technically simple possibility of preloading the coupling pins by means of a predetermined force, in particular in a first position in which they hold the touring boot in a normal position for downhill travel such that the touring boot is forced back from a pre-release position to a normal position by the force acting on the transmission part, in particular the force of a release spring means. The result is that the touring boot experiences the restoring force (release force) of the heel unit during its movement from its normal position along the release path towards the release position.

By modifying the predetermined release force, in particular the force of the release spring means, it is possible to directly affect the release behaviour (release force, release energy).

In principle, each of the two coupling pins could be brought into engagement with a separate transmission part to which a predetermined force is applied. To simplify the structure, however, it is preferable that the carrier portions of the coupling pins are brought into engagement or can be brought into engagement with a common transmission part such that the application of force to both coupling pins can be implemented with only one transmission part and in particular by using a common release spring means.

In a further preferred embodiment, it is intended that the carrier portions and the transmission part (or transmission parts) referred to above will slide past each other on respective guide portions during movement of the coupling projections. By means of this feature, it is possible to convert the circular motion of the carrier portions of the pivotably supported coupling pins due to sliding past the transmission part into a movement of the transmission part with a different direction or with a different type of motion.

The guide portions on which the carrier portions and the transmission part slide past each other may comprise first guide portions and second guide portions. In this case, the first guide portions may force the carrier portions onto a movement path which runs diagonally away from the sliding board plane and diagonally to the sliding board normal such that the effects described above of a tracking motion of the coupling projections are achieved, with the heel portion of the touring boot lifting upwards and movement of the coupling projections away from each other preparatory to the release of the touring boot. Moreover, the second guide portions may be configured in such a way that they transform the movement of the carrier portions into the movement of the transmission part counter to the action of the predetermined force. Thus, important mechanical parts of both the release mechanism and also of the tracking mechanism according to the invention may be provided simply by means of appropriate design of the guide portions, the carrier portions and the transmission part.

In a technically simple variant, the second guide portions of the type described above may have at least one guide surface running diagonally to the axis of the coupling pins. This guide surface may be configured on each carrier portion or/and on the transmission part and ensures that the essentially circular motion of the carrier portion diagonally upwards and outwards in relation to the sliding board can be converted into a motion of the transmission part in the desired direction, e.g. into a pivoting or displacement motion along the longitudinal axis (X-axis) of the sliding board. The latter variant particularly has the advantage that a release spring means can be disposed in a space-saving manner on the heel unit parallel to the longitudinal axis of the sliding board.

In a further embodiment of the invention, the transmission part may be attached pivotably to the binding body. A pivotable support has the advantage over a displaceable guide that it is largely possible to eliminate tilting or jamming of the transmission part and yet at the same time interaction with a spring means (e.g. compression spring) acting in a straight line is possible at a point of the transmission part which is at a distance from the pivot point.

In a further embodiment of the invention, the heel unit may also comprise a base part for attaching the heel unit to a touring sliding board whereby the binding body is displaceable in relation to the base part in the longitudinal direction (X-direction) of the sliding board and is preloaded towards the touring boot due to the action of a spring means. The displaceability of the binding body permits further improvement of the tolerance of the heel unit to temporary loads, particularly with a sporty skiing style, which should not yet lead to a release of the heel unit. In particular, the longitudinally movable support of the heel unit may compensate a relative movement between the heel unit and the front unit of the touring binding which occurs if there is flexure of the sliding board when travelling over a hollow in the ground. The binding body can thus always be kept in secure contact with the heel portion of the touring ski due to the action of the spring means even when flexure of the sliding board changes constantly during downhill travel.

The longitudinal displaceability of the binding body according to the embodiment described above may also be used as an insertion mechanism in order to allow the user to step into the downhill position of the touring binding when changing from the walking position to the downhill position, as the binding body together with the coupling projections for stepping in are pushed so far backwards that the touring boot pivotably supported on the front unit of the touring binding can be pivoted towards the sliding board and the recesses on the heel portion of the touring boot are located opposite the coupling projections. Then the binding body can move forwards towards the touring boot such that the coupling projections engage in the recess of the touring boot and the touring boot is fixed on the sliding board in the downhill position.

The abovementioned displacement of the binding body backwards in the longitudinal direction of the sliding board can be made easier by means of an insertion aid which enables the skier to get from the walking position of the touring binding into the downhill position by lowering the heel portion of the touring boot. To implement such an insertion aid, it is proposed that a boot control portion is provided on the binding body, said control portion having a control contour running diagonally to the sliding board plane and sloping up towards the distal end of the sliding board such that a touring boot, when approaching the sliding board for coupling the touring boot to the heel unit, displaces the binding body in the backward direction.

In a preferred embodiment of the abovementioned heel unit with longitudinally displaceable binding body, it is provided in particular that the boot control portion is supported on the transmission part, whereby the predetermined force which is necessary for moving the transmission part in the backward direction in relation to the binding body is greater than the force of the spring means with which the binding body is preloaded in the longitudinal direction of the sliding board. Thus, in addition to the tasks referred to above (cooperation with the carrier portions of the coupling pins), the transmission part can also take over the task of transmitting forces from the boot control portion to the binding body. The design of the heel unit can be further simplified in this way.

To make locomotion on the touring sliding board easier during an ascent, it is further proposed that the heel unit has at least one climbing aid which in a walking position of the heel unit is adjustable into an active position in which it supports a heel portion of a touring boot at a predetermined level above a sliding board plane. Such a climbing aid will support the touring boot in particular at a level above the coupling projections and can be attached pivotably on the heel unit, for example. The level of the climbing aid is preferably adjustable for adaptation to a gradient or the heel unit comprises a plurality of climbing aids which in the walking position of the touring binding can be pivoted optionally from an inactive position outside the pivot range of the touring boot into an active position for supporting the touring boot. In particular, a plurality of climbing aids can be stacked above each other in the active position in order to achieve the desired support level.

The abovementioned boot control unit for providing an insertion aid for the touring boot can be advantageously combined with the at least one climbing aid if the at least one climbing aid (for stepping into the heel unit) is adjustable into a position in which the boot control portion is disposed above the coupling projections and the control contour of the boot control portion runs diagonally to the sliding board plane and slopes up towards the distal end of the sliding board. In this way, on moving the at least one climbing aid from the active position into the inactive position, the boot control portion can simultaneously be placed in the required position for function of the insertion aid such that operation of the heel unit is made easier when changing from the walking position to the downhill position and the structure of the heel unit is simplified.

In a further embodiment of the present invention, the heel unit may comprise a base part for attaching the heel unit to a touring sliding board, whereby the binding body is pivotable in relation to the base part about an axis essentially orthogonal to the sliding board plane. The pivotability of the binding body about the essentially orthogonal axis can be used on the one hand for adjusting the heel unit between the downhill position and a walking position for flat terrain in which the coupling projections are pivoted sideways away from the heel portion of the touring boot, such that the heel portion can lift freely from the sliding board and the touring boot is movable about the pivot support of the front unit. On the other hand, the pivoting motion of the binding body about the essentially orthogonal axis can be preloaded in the normal downhill position by means of an Mz-release spring such that an Mz-release mechanism is provided in order to release the touring boot in the event of a high torque about a vertical axis of rotation (in a fall).

BRIEF DESCRIPTION OF THE SEVERAL VIEWS OF THE DRAWING(S)

Figure 2:
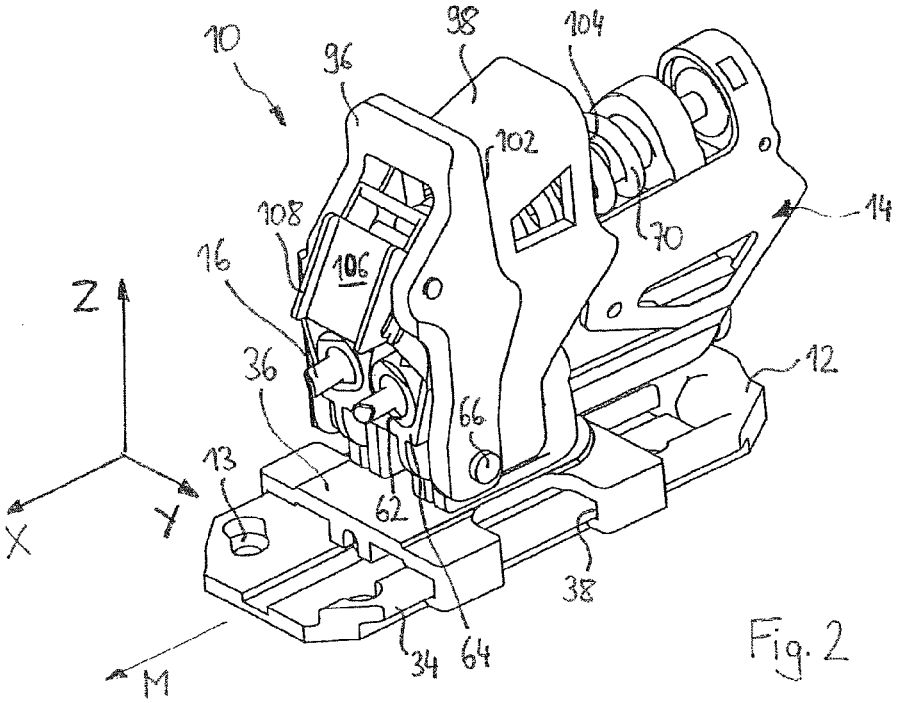
Figure 4:
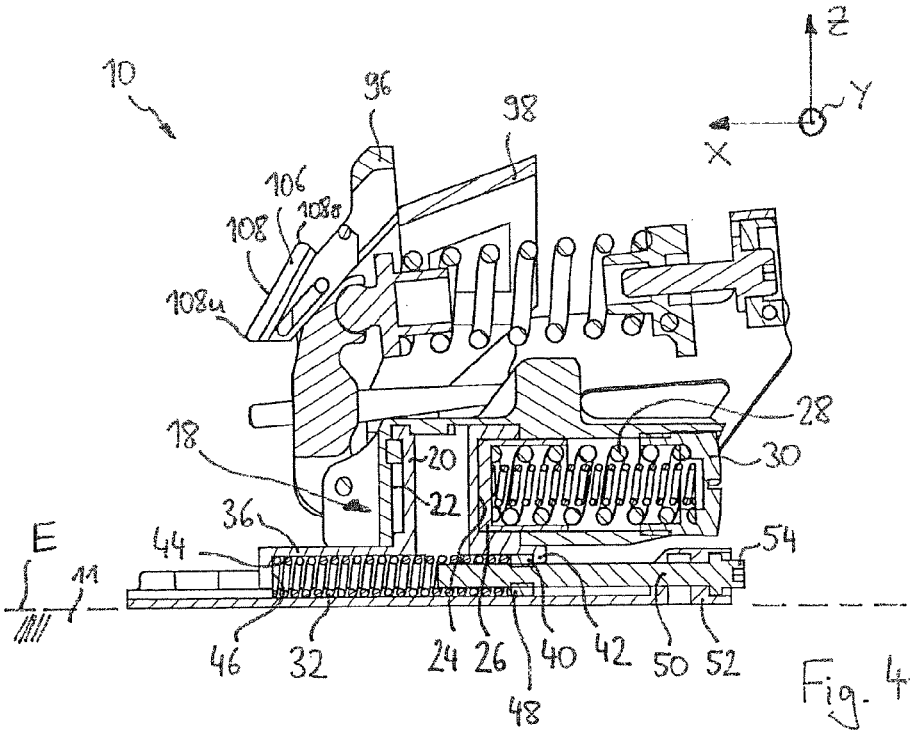
Figure 3:
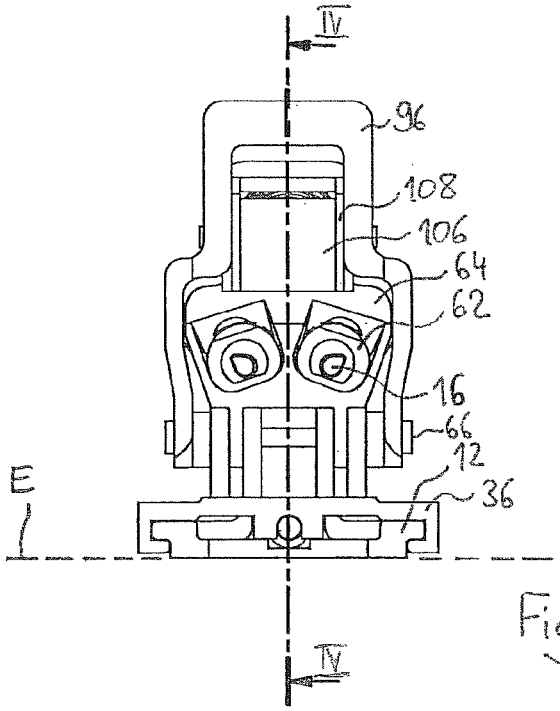
Figure 6:
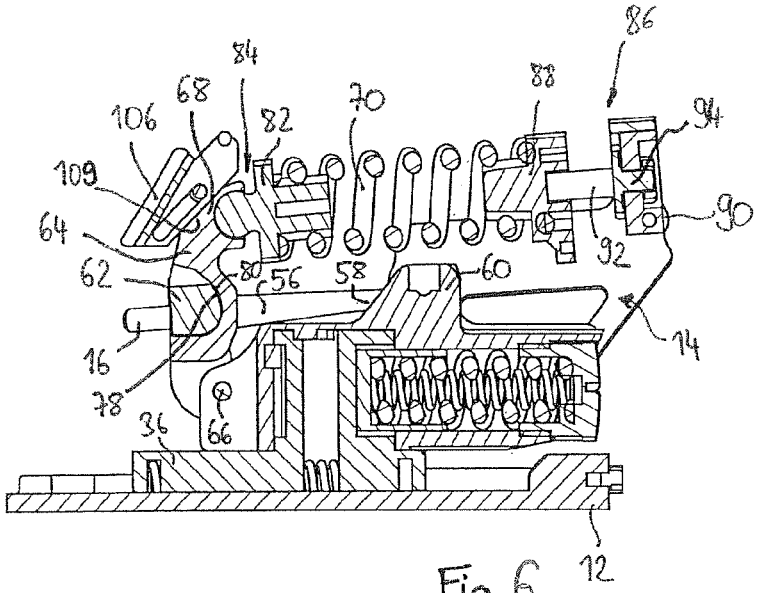
Figure 5:
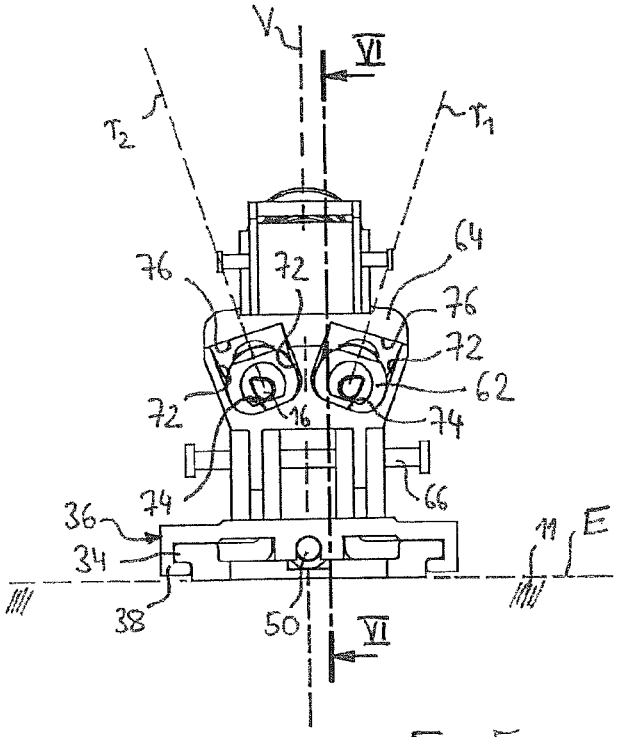
Figure 7:
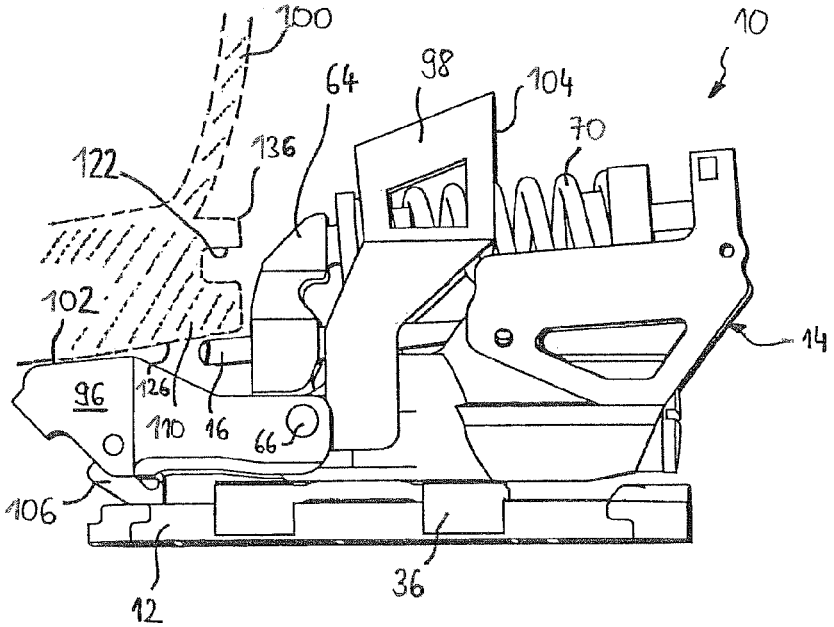

The invention will be explained in greater detail on the basis of a preferred exemplary embodiment with reference to the associated figures. The drawings show:

FIG. 1 a rear view of a heel portion of a touring boot,

FIG. 2 a perspective view of a heel unit according to the embodiment of the invention, FIG. 3 a front view of the heel unit of the embodiment, FIG. 4 a sectional view of the heel unit of the embodiment corresponding to a section line IV-IV in FIG. 3, FIG. 5 a front view of the heel unit of the embodiment with dismantled climbing aids, FIG. 6 a sectional view of the heel unit of the embodiment corresponding to a sectional line VI-VI in FIG. 5, and FIG. 7 a lateral view of the heel unit of the embodiment in a walking position with a first climbing aid in active position.

DETAILED DESCRIPTION OF THE INVENTION

A heel unit 10 of the embodiment of the present invention comprises a base part 12 to be attached to a sliding board 11, a binding body 14 held on base part 12 and coupling projections 16 held on binding body 14 for engagement with a heel portion 110 (FIG. 1) of a touring boot 100.

Attachment means, in particular attachment holes 13, for attaching base part 12 to sliding board 11 define a sliding board plane E of a sliding board 11 (horizontal plane in this disclosure) joined to the heel unit and a sliding board longitudinal axis M along a central axis of the sliding board. The sliding board longitudinal axis M runs in an X direction of a coordinate system of the heel unit. A sliding board normal which stands perpendicular to sliding board plane E runs in a Z direction of the coordinate system, and a Y direction of the coordinate system runs orthogonally to the X direction as well as orthogonally to the Z direction.

Binding body 14 can be held pivotably about an axis running in the Z direction in relation to base part 12 at a bearing arrangement 18. To this end, bearing arrangement 18 may comprise a bearing journal 20 which is inserted in an associated recess 22 of binding body 14. Support of binding body 14 on bearing journal 20 is preferably preloaded in a downhill position in which coupling projections 16 point forwards in the X direction.

An Mz-release mechanism known per se which is described for example in EP 0 199 098 A2 may be provided for preloading binding body 14 in the downhill position. The details described in EP 0 199 098 A2 for the rotatable support of a binding body with coupling pins on a journal extending in a vertical direction and for the spring arrangement acting between these elements should be incorporated entirely in the present disclosure by reference. Thus a cam surface 24 can be provided on the outer surface of bearing journal 20 past which cam surface a cam follower 26 slides during a relative rotation between binding body 14 and bearing journal 20, said cam follower 26 is movably guided on binding body 14 and is preloaded in the contact with cam surface 24 by the force of an Mz-release spring 28. On the one hand, Mz-release spring 28 can be supported in the process on a preload adjustment element 30 which is attached in a position on binding body 14 that is adjustable but which is fixed during normal operation and on the other hand can be supported on cam follower 26. Preload adjustment element 30 may be a screw such that the distance between the two support points of Mz-release spring 28 and therefore preloading of Mz-release spring 28 is adjustable by turning the screw.

The contour of cam surface 24 is selected such that binding body 14 is preloaded in the downhill position in which coupling projections 16 point essentially forwards in the X direction. In addition, cam surface 24 is shaped in such a way that, on a rotating motion of binding body 14, cam follower 26 is forced in the direction of a compression of Mz-release spring 28 such that the pivoting motion of binding body 14 out of the downhill position is opposed by a force. If this force exceeds a predetermined Mz-release force, perhaps because a heel portion of touring boot 100 is pushed in the lateral direction (Y direction) in the event of a fall and twisting of the sliding board, then the force of Mz-release spring 28 is overcome and binding body 14 pivots away sideways together with coupling projections 16 such that the touring boot is disengaged. This movement is the Mz-release movement of binding body 14 or of coupling projections 16.

Bearing arrangement 18 with which binding body 14 is supported on base part 12 additionally comprises a spring bearing which permits an elastic movement of binding body 14 and therefore of coupling projections 16. In the variant illustrated, bearing journal 20 is thus guided so as to be linearly displaceable in the X direction on base part 12 and is preloaded in the forward direction (towards touring boot 100) due to the action of a spring element 32.

The linear guide may comprise a first rail portion 34 configured on base part 12 and a second rail portion 38 configured on a slide 36 coming into moving contact with first rail portion 34. Bearing journal 20 can be joined to slide 36 and be movable along the X direction on base part 12. Slide 36 is preloaded forwards in the X direction by spring element 32. Its direction of motion forwards in the X direction is limited by a first limit stop 40 which is normally held fixed in relation to base part 12 (i.e. during normal operation, e.g. during downhill travel). Slide 36 strikes against first limit stop 40 with a second limit stop 42 if no force acts on binding body 14 in the X direction (e.g. with the touring boot disengaged).

In the exemplary embodiment, spring element 32 is accommodated in a recess 44 of slide 36 open towards the sliding board and is supported with its front end on a front limiting wall 46 of recess 44 while the distal end of spring element 32 rests on a spring bearing 48 which in normal operation is held fixed in relation to base part 12. Spring bearing 48 preferably also forms first limit stop 40 such that spring bearing 48 has a dual function for supporting spring element 32 and limiting the movement of slide 36.

In the embodiment of the invention, spring bearing 48 may be adjustable in its position relative to base part 12 so as to be able to adjust the unloaded position of slide 36 along the X direction. For this, spring bearing 48 may be provided as a threaded nut through which a thread screw 50 running in the X direction passes in threaded engagement. Screw 50 may be supported at its end distant from spring bearing 48 on a bearing portion 52 of base part 12 in such a way that screw 50 can rotate about its longitudinal axis but cannot move in the X direction. For adjusting screw 50, it may have a screw head 54 with a portion for tool engagement. Spring element 32 is preferably configured as a coil spring in such a manner that screw 50 passing through spring bearing 48 can penetrate unimpeded into the interior of the coil spring.

The following section will describe a My-release mechanism for the heel unit of the embodiment of the invention. The My-release mechanism comprises coupling projections 16 which are held movably on binding body 14. At the same time, coupling projections 16 are preferably configured on front ends of two coupling pins 56 which, on retaining portions 58 facing away from coupling projections 16, are pivotably supported on pin bearing portions 60 of the binding body. Pin bearing portions 60 support coupling pins 56 in such a way that coupling projections 16 are movable in at least one direction which runs away from the sliding board plane.

Carrier portions 62 on coupling pins 56 are configured or attached between coupling projections 16 and retaining portions 58. Carrier portions 62 of both coupling pins 56 are preferably in contact with a common transmission part 64 which is held movably on binding body 14 such that movement of pins 56 is converted via carrier portions 62 into a movement of transmission part 64. Transmission part 64 may be linked pivotably on binding body 14 to a pivot axis 66 running in the Y direction. Transmission part 64 preferably also has a spring bearing 68, in particular a spring bearing 68 at a distance from pivot axis 66, for supporting a My-release spring 70. The contact between carrier portions 62 and transmission part 64 takes place in a section of transmission part 64 situated between spring bearing 68 and pivot axis 66 in order to improve the transmission of force between transmission part 64 and My-release spring 70 due to the lever action of transmission part 64.

It can be seen in FIGS. 3 and 5 that carrier portions 62 slide past on first guide surfaces 72 of transmission part 64 which run essentially parallel to the axes of coupling pins 56 on both sides of carrier portions 62 and force carrier portions 62 onto movement paths along the directions of motion $r_1$ and $r_2$. Directions of motion $r_1$ and $r_2$ of carrier portions 62 run diagonally away from sliding board plane E as well as diagonally to the Z direction (sliding board normal). As can be seen in FIG. 5, directions of motion $r_1$ and $r_2$ run in a V-shape and symmetrically to a vertical longitudinal centre plane V which runs orthogonally to sliding board plane E in the X direction and bisects the sliding board in the longitudinal direction. With longitudinal centre plane V, directions of motion $r_1$ and $r_2$ can each include an angle between approximately 10 degrees and approximately 45 degrees, particularly preferably an angle between approximately 15 degrees and approximately 30 degrees.

A normal position stop 74 or/and a release position stop 76 for carrier portions 62 can also be configured on transmission part 64 in order to limit the pivot range of coupling pins 56 in at least one of the two positions, normal position and release position. In a constructively simple manner, as can be seen in the embodiment, first guide surfaces 72, normal position stop 74 and release position stop 76 can be provided together as inner limiting walls of a common recess. The coupling between carrier portions 62 and transmission part 64 can then be described in each case as a slotted hole coupling in which transmission part 64 has two slots arranged essentially in a V-shape in which slots carrier portions 62 are guided along the directions of motion $r_1$ and $r_2$ and are limited in respect of their movement limit positions.

Transmission part 64 preferably has second guide surfaces 78 for each of carrier portions 62 of coupling pins 56 where carrier portions 62 rest on rear 80 of said guide surfaces. Second guide surfaces 78 are configured such that transmission part 64 is pivoted about pivot point 66 when carrier portions 62 glide past second guide surfaces 78 during a pivot movement of coupling pins 56 along directions of motion $r_1$ and $r_2$. This can be implemented by means of a guide surface 78 running diagonally to the axis of coupling pins 56 or a guide surface 78 configured in a trough shape.

Second guide surfaces 78 may be joined in a constructively simple manner to first guide surfaces 72 by configuring second guide surfaces 78 as the base of a recess whose side walls are formed by first guide surfaces 72 (and if necessary by limit stops 74, 76). Provided on base 78 of the recess is a slot whose dimensions are smaller than the dimensions of the recess and through which a narrower portion of coupling pins 56, but not carrier portions 62, can be threaded.

As already mentioned, a front end of a My-release spring 70 may be supported on a spring bearing 68 of transmission part 64. In the exemplary embodiment, a bearing journal 82 attached on the front end of My-release spring 70 is supported by way of a ball joint coupling 84 on spring bearing 68 of transmission part 64. Ball joint coupling 84 ensures the conversion of the pivot movement of spring bearing 68 of transmission part 64 into an essentially linear compression movement of My-release spring 70 such that My-release spring 70 is only activated along its straight-line direction of compression or decompression.

My-release spring 70 is essentially oriented in the X direction. At the distal end, My-release spring 70 may be directly coupled to a portion fixed to the binding body or, as illustrated in the embodiment, may be equipped with a My-release force adjusting mechanism 86 to provide the opportunity for adjusting the preloading force of My-release spring 70 and thus adjusting the My-release force. My-release force adjusting mechanism 86 may comprise a second bearing journal 88 which is attached on a distal end of My-release spring 70 and whose distance from a bearing section 90 fixed to the binding body can be adjusted by moving a thread screw 92. Thread screw 92 may be rotatably supported on bearing portion 90 but is immovable in the direction of My-release spring 70, and may be in engagement with an internal thread of second bearing journal 88 such that second bearing journal 88 of My-release spring 70 can be moved in the axial direction by turning thread screw 92, in particular by operating it via a portion for tool engagement 94 on the end of thread screw 92. In this way, preloading of release spring 70 can be adjusted to influence the My-release behaviour of heel unit 10.

Heel unit 10 may also comprise a first climbing aid 96 and a second climbing aid 98 which are pivotably attached to heel unit 10 in order to be optionally pivoted individually or together into a region between the sliding board and the touring boot (active position) such that touring boot 100 can be supported at a corresponding level above the sliding board. In a manner known per se, walking on a slope is made easier in this way. Both climbing aids 96, 98 are preferably supported on a common pivot axis which runs in the Y direction. A special saving on installation space and components can additionally be achieved if, on common pivot axis 66 of climbing aids 96, 98, transmission part 64 is also pivotably supported on binding body 14.

Arranged on first climbing aid 96 is a boot control portion 106 which has a control contour 108 running diagonally to sliding board plane E and sloping up towards the distal end of the sliding board. A lower end 108*u* of control contour 108 terminates in relation to the X direction at approximately the level of the front ends of coupling projections 16 or even protrudes in the forward direction beyond the front ends of coupling projections 16. An upper end 108*o* of control contour 108 lies in the X direction behind the front ends of coupling projections 16. Control contour 108 with sliding board plane E preferably includes an angle between approximately 45 and approximately 75 degrees in order to ensure safe sliding of the heel portion of the touring boot and at the same time to guarantee an adequate displacement path of binding body 14 in the X direction.

The following section will explain the manner of operation of heel unit 10 of the embodiment of the invention. In the unloaded normal position shown in the figures, first limit stop 40 of spring bearing 48 rests on second limit stop 42 of slide 36, coupling pins 56 are in their normal position in which coupling projections 16 assume their lowest and converging position, in particular carrier portions 62 rest on normal position stops 74. Touring boot 100 is disengaged from heel unit 10.

If the touring boot is pivotably brought into engagement on the front unit of the touring binding, such that it can pivot in its front portion about a pivot axis running in the Y direction while coupling projections 16 are disengaged from touring boot 100, then the touring binding is in a walking position. For walking in flat or slightly upward sloping terrain, first climbing aid 96 is folded down until it is supported on the upper side of sliding board 11 or on the upper side of base part 12, as illustrated in FIG. 7. A first boot support 102 of first climbing aid 96 is then disposed at a first climbing aid level above the sliding board plane E (approximately at the level of coupling projections 16 or above) in order to support heel portion 110 of touring boot 100 at this level. For an ascent with a steep incline, second climbing aid 98 can also be folded down until it is supported on first climbing aid 96 and a second boot support 104 of second climbing aid 98 supports heel portion 110 of touring boot 100 at a second higher climbing aid level above sliding board plane E.

At the end of the ascent and in preparation for a descent, the touring binding must be moved from the walking position to the downhill position. To do this, first or second climbing aids 96, 98 which were folded down as necessary are folded up such that boot control portion 106 is located within the pivot range of heel portion 110 of touring boot 100. If heel portion 110 is lowered and comes up against control contour 108, then heel portion 110 slides past control contour 108 and in the process forces boot control portion 106 backwards. As boot control portion 106 rests with its back side 109 on transmission part 64, the movement of boot control portion 106 in the X direction is transmitted backwards to transmission part 64. My-release spring 70 has a higher spring constant or a higher preload than spring element 32 of the spring bearing on which binding body 14 is movably held in the X direction in relation to base part 12. The backward displacement of boot control portion 106 brought about by touring boot 100 does not therefore lead to a pivot movement of transmission part 64 but rather displaces binding body 14 in the backward direction by compressing spring element 32.

When heel portion 110 of touring boot 100 reaches lower end 108*u* of control contour 108, then binding body 14 is displaced so far in the backward direction that the front ends of coupling projections 16 are disposed in the X direction at the same level as heel portion 110 or behind heel portion 110. Heel portion 110 can therefore slide further downwards on lower end 108*u* of control contour 108 until latching portions 130 on heel portion 110 of touring boot 100 line up sufficiently with coupling projections 16. If an upper edge 136 of heel portion 110, on which heel portion 110 forms a step-like protrusion in relation to touring boot 100, finally passes the lower end 108*u* of control contour 108, then heel portion 110 finally slides off boot control portion 106 whereupon binding body 14 is pushed forwards by the force of spring element 32 and coupling projections 16 enter recesses 122 of touring boot 100 so as to engage with touring boot 100.

In this manner, the skier can get into the downhill position of the touring binding in that touring boot 100 held pivotably on the front unit of the touring binding is pushed towards the sliding board by means of a simple movement until coupling projections 16 engage in recesses 122 of touring boot 100. The force sufficient for this depends on the spring force of spring element 32 and is therefore in particular independent of the spring force of My-release spring 70. In this way, it can be achieved that, even when using a My-release spring 70 with very high tensioning force to enable a particularly sporty skiing style, it is relatively easy to step into the touring binding since the compressive force necessary for insertion can be defined by spring element 32 independently of My-release spring 70.

During downhill travel, the longitudinally adjustable support of binding body 14 under the effect of spring element 32 takes over the task of dynamically compensating a ski deflection when passing over uneven ground such that during downhill travel binding body 14 can always be held in secure engagement and in close contact with the heel portion of the touring boot.

If a momentary shock or impact load occurs during downhill travel, for example when travelling over a rock or during a particularly demanding ski manoeuvre, then it is generally not desirable for heel unit 10 to release. If the momentary impact force acting on heel portion 110 in the direction of arrow A is close to a force that is greater than the My-release force of the My-release mechanism of heel unit 10, which depends among other things on the force of My-release spring 70, then heel portion 110 of touring boot 100 begins to lift off the sliding board in the direction of arrow A. As coupling projections 16 are in engagement at latching portions 130 of recesses 122 of heel portion 110, during this movement coupling projections 16 are also raised upwards away from sliding board plane E by a force acting in the direction of arrow A. The upwards movement of coupling projections 16 forces a V-shaped upwards movement of both coupling projections 16 by way of the guidance of carrier portions 62 on transmission part 64 in such a manner that the distance of both coupling projections 16 from the sliding board plane increases and the distance between both coupling projections 16 also increases.

During this release movement of coupling projections 16, and therefore of coupling pins 56, back sides 80 of carrier portions 62 also slide past second guide surfaces 78 of transmission part 64 and pivot transmission part 64 (clockwise in FIG. 6) against the force of My-release spring 70. This means that during the entire release movement of pins 56, a force effect in accordance with the release force acts on coupling pins 56 which counteracts the upwards movement of heel portion 110. Therefore, if in the situation described above of a momentary shock or impact load, the external load on touring boot 100 decreases again before the entire release path has been covered, i.e. before coupling projections 16 have reached a sufficient distance from each other to pass beyond release projections 128 of heel portion 110, then the force of My-release spring 70 returns touring boot 100 back to the normal position. Thus it is possible to prevent release in the case of a merely temporary, momentary impact load.

However, if the force effect on touring boot 100 in the direction of arrow A is maintained with an intensity overcoming the release force for a longer time (for example during a fall by the skier), then coupling pins 56 are pivoted so far that coupling projections 16 finally pass beyond release projections 128 on heel portion 110 of touring boot 100 such that coupling projections 16 out of opening portions 124 of touring boot 100 can escape out of recesses 122 towards sole 126 and touring boot 100 is therefore disengaged from heel unit 10. Therefore reliable release of heel unit 10 is ensured during a fall.

The invention claimed is:

1. A heel unit for a touring binding of a sliding board, comprising:

a binding body on which two coupling projections for connection to a heel portion of a touring boot are movably held by a movable retainer, wherein the movable retainer of the coupling projections is configured such that the coupling projections move away from a sliding board plane, wherein the movable retainer of the coupling projections is configured for a movement of the coupling projections from a first position into a second position counter to the action of a release force, wherein a distance of the coupling projections from the sliding board plane is greater in the second position than in the first position, and wherein an intermediate distance of the coupling projections from each other is greater in the second position than in the first position.

2. The heel unit according to claim 1, wherein the movable retainer of the coupling projections is configured such that the coupling projections each move along a direction of motion which runs diagonally away from the sliding board plane and diagonally with respect to the direction of a sliding board normal.

3. The heel unit according to claim 1, wherein the coupling projections are provided on front ends of coupling pins, and wherein the coupling pins each comprise a retaining portion on which the respective coupling pin is pivotably supported on the binding body.

4. The heel unit according to claim 3, wherein carrier portions are provided on the coupling pins, wherein the carrier portions are configured so as to be brought into engagement with a transmission part, and wherein the transmission part is movably held on the binding body such that in at least one direction it is only movable by overcoming a predetermined force.

5. The heel unit according to claim 4, wherein the carrier portions and the transmission part slide past each other at respective guide portions on movement of the coupling projections.

6. The heel unit according to claim 5, wherein the guide portions comprise a first guide portion and a second guide portion, wherein the first guide portion is configured to force the carrier portions onto a movement path which runs diagonally away from the sliding board plane and diagonally with respect to the direction of a sliding board normal, and wherein the second guide portion is configured to translate the movement of the carrier portions into a movement of the transmission part against the action of the predetermined force.

7. The heel unit according to claim 6, wherein the second guide portion comprises at least one guide surface running diagonally to an axis of at least one of the coupling pins.

8. The heel unit according to claim 4, wherein the transmission part is pivotably attached to the binding body.

9. The heel unit according to claim 4, further comprising a base part configured to attach the heel unit to a touring sliding board, wherein the binding body is movable in relation to the base part in the longitudinal direction of the sliding board and is preloaded towards the touring boot due to the action of a spring means.

10. The heel unit according to claim 9, wherein a boot control portion is provided on the binding body, wherein the control portion comprises a control contour running diagonally to the sliding board plane and sloping up towards a distal end of the sliding board, and wherein the control portion and the control contour are configured such that the touring boot, when approaching the sliding board for coupling the touring boot to the heel unit, displaces the binding body in a backward direction.

11. The heel unit according to claim 10, wherein the boot control portion is supported on the transmission part or the boot control portion is provided on the transmission part, and wherein a predetermined force which is necessary for moving the transmission part in the backward direction in relation to the binding body is greater than the force of the spring means with which the binding body is preloaded towards the touring boot.

12. The heel unit according to claim 10, wherein the boot control portion is attached to at least one climbing aid, and wherein the at least one climbing aid is adjustable into a position in which the boot control portion is disposed above the coupling projections.

13. The heel unit according to claim 4, wherein the predetermined force is a force of a release spring means.

14. The heel unit according to claim 1, wherein the heel unit comprises at least one climbing aid which in a walking position of the heel unit is adjustable into a position in which it supports the heel portion of the touring boot at a predetermined level above the sliding board plane.

15. The heel unit according to claim 1, further comprising a base part for attachment of the heel unit to a touring sliding board, wherein the binding body is pivotable in relation to the base part about an axis essentially orthogonal to the sliding board plane.

16. The heel unit according to claim 1, further comprising a base part for attachment of the heel unit to a touring sliding board, wherein the binding body is movable in relation to the base part in the longitudinal direction of the sliding board and is preloaded towards the touring boot due to the action of a spring means.

17. A heel unit for a touring binding of a sliding board, comprising:

a binding body on which two coupling projections for connection to a heel portion of a touring boot are movably held by a movable retainer, wherein the movable retainer of the coupling projections is configured such that the coupling projections move away from a sliding board plane, wherein the coupling projections are provided on front ends of coupling pins, and wherein the coupling pins each comprise a retaining portion on which the respective coupling pin is pivotably supported on the binding body, wherein carrier portions are provided on the coupling pins, and wherein the carrier portions are configured so as to be brought into engagement with a transmission part, and wherein the transmission part is movably held on the binding body such that in at least one direction it is only movable by overcoming a predetermined force, wherein the carrier portions and the transmission part slide past each other at respective guide portions on movement of the coupling projections, wherein the guide portions comprise a first guide portion and a second guide portion, wherein the first guide portion is configured to force the carrier portions onto a movement path which runs diagonally away from the sliding board plane and diagonally with respect to the direction of a sliding board normal, wherein the second guide portion is configured to translate the movement of the carrier portions into a movement of the transmission part against the action of the predetermined force, and wherein the second guide portion comprises at least one guide surface running diagonally to an axis of at least one of the coupling pins.

18. A heel unit for a touring binding of a sliding board, comprising:

a binding body on which two coupling projections for connection to a heel portion of a touring boot are movably held by a movable retainer, wherein the movable retainer of the coupling projections is configured such that the coupling projections move away from a sliding board plane, wherein the coupling projections are provided on front ends of coupling pins, and wherein the coupling pins each comprise a retaining portion on which the respective coupling pin is pivotably supported on the binding body, wherein carrier portions are provided on the coupling pins, and wherein the carrier portions are configured so as to be brought into engagement with a transmission part, and wherein the transmission part is movably held on the binding body such that in at least one direction it is only movable by overcoming a predetermined force; and a base part configured to attach the heel unit to a touring sliding board, wherein the binding body is movable in relation to the base part in the longitudinal direction of the sliding board and is preloaded towards the touring boot due to the action of a spring means, wherein a boot control portion is provided on the binding body, wherein the control portion comprises a control contour running diagonally to the sliding board plane and sloping up towards a distal end of the sliding board, and wherein the control portion and the control contour are configured such that the touring boot, when approaching the sliding board for coupling the touring boot to the heel unit, displaces the binding body in a backward direction.

19. The heel unit according to claim 18, wherein the boot control portion is supported on the transmission part or the boot control portion is provided on the transmission part, and wherein a predetermined force which is necessary for moving the transmission part in the backward direction in relation to the binding body is greater than the force of the spring means with which the binding body is preloaded towards the touring boot.

20. The heel unit according to claim 18, wherein the boot control portion is attached to at least one climbing aid, and wherein the at least one climbing aid is adjustable into a position in which the boot control portion is disposed above the coupling projections.

* * * * *